US008212137B1

(12) United States Patent
Hosler

(10) Patent No.: US 8,212,137 B1
(45) Date of Patent: Jul. 3, 2012

(54) DETACHABLE PICKUP ASSEMBLY

(75) Inventor: David Hosler, El Cajon, CA (US)

(73) Assignee: Taylor-Listug, Inc., El Cajon, CA (US)

( * ) Notice: Subject to any disclaimer, the term of this patent is extended or adjusted under 35 U.S.C. 154(b) by 0 days.

(21) Appl. No.: 13/082,175

(22) Filed: Apr. 7, 2011

(51) Int. Cl.
*G10H 1/32* (2006.01)
*G10H 3/00* (2006.01)

(52) U.S. Cl. ..... 84/743

(58) Field of Classification Search ..... 84/743
See application file for complete search history.

(56) References Cited

U.S. PATENT DOCUMENTS 3,296,916 A 1/1967 Palmer
3,475,543 A 10/1969 Burns
4,227,434 A 10/1980 DiMarzio
4,501,186 A * 2/1985 Ikuma ..... 84/726
4,519,287 A 5/1985 Naruse
4,854,210 A * 8/1989 Palazzolo ..... 84/726
4,941,389 A 7/1990 Wendler
5,010,803 A 4/1991 Donnell
5,018,204 A * 5/1991 Christian ..... 381/74
5,422,955 A 6/1995 Guzman et al.
5,614,688 A * 3/1997 Donnell ..... 84/743
6,194,644 B1 * 2/2001 Hendrickson ..... 84/291
7,015,390 B1 3/2006 Rogers
7,115,809 B2 * 10/2006 Kavanaugh ..... 84/726
7,844,069 B2 * 11/2010 Banks ..... 381/361

* cited by examiner

*Primary Examiner* — Jeffrey Donels
(74) *Attorney, Agent, or Firm* — Peter K. Hahn; Pillsbury Winthrop Shaw Pittman, LLP

(57) ABSTRACT

A detachable pickup assembly comprises a mounting assembly including a first body having a pickup mounting portion and a connection mechanism comprising one or more clip members. A second body defines a connection portion sized to receive the one or more clip members and has a top surface engageable with an inside surface of a guitar body. A pickup is fixedly mounted to the pickup mounting portion of the first body.

21 Claims, 9 Drawing Sheets

DETACHABLE PICKUP ASSEMBLY

FIELD

The present disclosure relates to detachable acoustic instrument pickup assemblies.

BACKGROUND

Sound pickups and amplification systems are used with various stringed instruments to sense string vibrations, convert those vibrations into electrical signals and amplify and project the resulting sound. Often, musicians who play acoustic instruments have the need to switch back and forth between projecting sound acoustically and picking up the sound to be electrically amplified. Accordingly, detachable pickups have been designed specifically for instruments constructed to project sound acoustically. However, known detachable pickup assemblies suffer from significant disadvantages.

A common drawback of existing detachable pickup assemblies is that they are difficult to attach and detach or awkward to plug in. These disadvantages include the size of the pickup assemblies, which may be unduly large and cumbersome. The location of the attachment mechanism on the instrument may be difficult for the user to reach as well. In addition, some detachable pickup assemblies require the entire assembly to be attached and detached each time. But even pickup assemblies that have a permanently attached component and a detachable component can be difficult to plug in as they may require screws or other types of fasteners. In some cases, entire pickup assemblies or mounting assemblies require after-market installation, which can be difficult and expensive.

Therefore, there exists a need for a detachable pickup assembly that is compact, situated at a convenient location and can be attached and detached quickly and easily. There also is a need for a detachable pickup assembly that has a permanently attached component that can be installed by the manufacturer so the user only needs to detach a small detachable component.

SUMMARY

The present disclosure, and its many embodiments, alleviates to a great extent the disadvantages of known detachable pickup assemblies by providing a pickup assembly in which a pickup is mounted on a first body that can form a snap fit with a second body that is engageable with an inside surface of a guitar body. More particularly, the first body has a connection mechanism that may comprise end clip members with securing flanges that form a snap fit with a connection portion of the second body defined of cross members.

Embodiments of a detachable pickup assembly comprise a mounting assembly that includes a first body, a second body and a pickup mounted to the first body. The first body has a pickup mounting portion and a connection mechanism comprising one or more clip members. The one or more clip members may comprise two end clip members and one middle clip member. Each of the two end clip members may comprise a downward facing securing flange. The middle clip member may comprise an upward facing securing flange and may be sloped upward.

The second body defines a connection portion sized to receive the one or more clip members and has a top surface engageable with an inside surface of an acoustic instrument body. The connection portion of the second body may be defined by upper and lower cross members, and the securing flanges of the end clip members and cross members may form a snap fit. The pickup is fixedly mounted to the pickup mounting portion of the first body, and the pickup mounting portion may define a ring in which the pickup is mounted. A jack may be operatively coupled to the pickup.

Embodiments of the disclosure include a mounting mechanism comprising a first body having a pickup mounting portion and a connection mechanism comprising one or more clip members and a second body defining a connection portion sized to receive the one or more clip members. The second body further has a top surface engageable with an inside surface of a guitar body. Embodiments of a mounting mechanism further comprise a pickup fixedly mounted to the pickup mounting portion of the first body. The pickup mounting portion of the first body may define a ring in which the pickup may be mounted. The one or more clip members of the first body's connection mechanism may comprise two end clip members and one middle clip member. One or more of the one or more clip members may comprise a downward facing securing flange, and one or more of the one or more clip members comprises an upward facing securing flange. The connection portion of the second body may be defined by upper and lower cross members, and the connection mechanism of the first body and the connection portion of the second body may form a snap fit.

Embodiments of the disclosure further include an acoustic-electric convertible guitar that comprises a hollow-body guitar and a detachable pickup assembly. The detachable pickup assembly includes a mounting assembly, a pickup and a jack operative coupled to the pickup. The mounting assembly includes a first body and a second body. The first body comprises a pickup mounting portion and a connection mechanism including one or more clip members, which may comprise two end clip members and one middle clip member. A pickup fixedly mounted to the pickup mounting portion of the first body, and the pickup mounting portion may define a ring in which the pickup is mounted. A jack may be operatively coupled to the pickup. Each of the two end clip members may comprise a downward facing securing flange, and the middle clip member may comprise an upward facing securing flange. The second body defines a connection portion sized to receive the one or more clip members, and the securing flanges of the end clip members may form a snap fit with the connection portion. The second body also has a top surface fixedly mounted to an inside surface of the hollow-body guitar. Thus, embodiments of the disclosure provide pickup mounting assemblies wherein a first body mounts a pickup and can form a snap fit with a connection portion of a second body that is engageable with an inside surface of a guitar body. Embodiments of disclosed pickup assemblies provide a quick and easy attachment and detachment mechanism. These and other features and advantages of the present disclosure will be appreciated from review of the following detailed description of the disclosure, along with the accompanying figures in which like reference numerals refer to like parts throughout.

BRIEF DESCRIPTION OF THE DRAWINGS

The foregoing and other objects of the disclosure will be apparent upon consideration of the following detailed description, taken in conjunction with the accompanying drawings, in which.

DETAILED DESCRIPTION

In the following paragraphs, embodiments of the present disclosure will be described in detail by way of example with reference to the accompanying drawings, which are not drawn to scale, and the illustrated components are not necessarily drawn proportionately to one another. Throughout this description, the embodiments and examples shown should be considered as exemplars, rather than as limitations on the present disclosure. As used herein, the "present disclosure" refers to any one of the embodiments of the disclosure described herein, and any equivalents. Furthermore, reference to various aspects of the disclosure throughout this document does not mean that all claimed embodiments or methods must include the referenced aspects.

Figure 1:
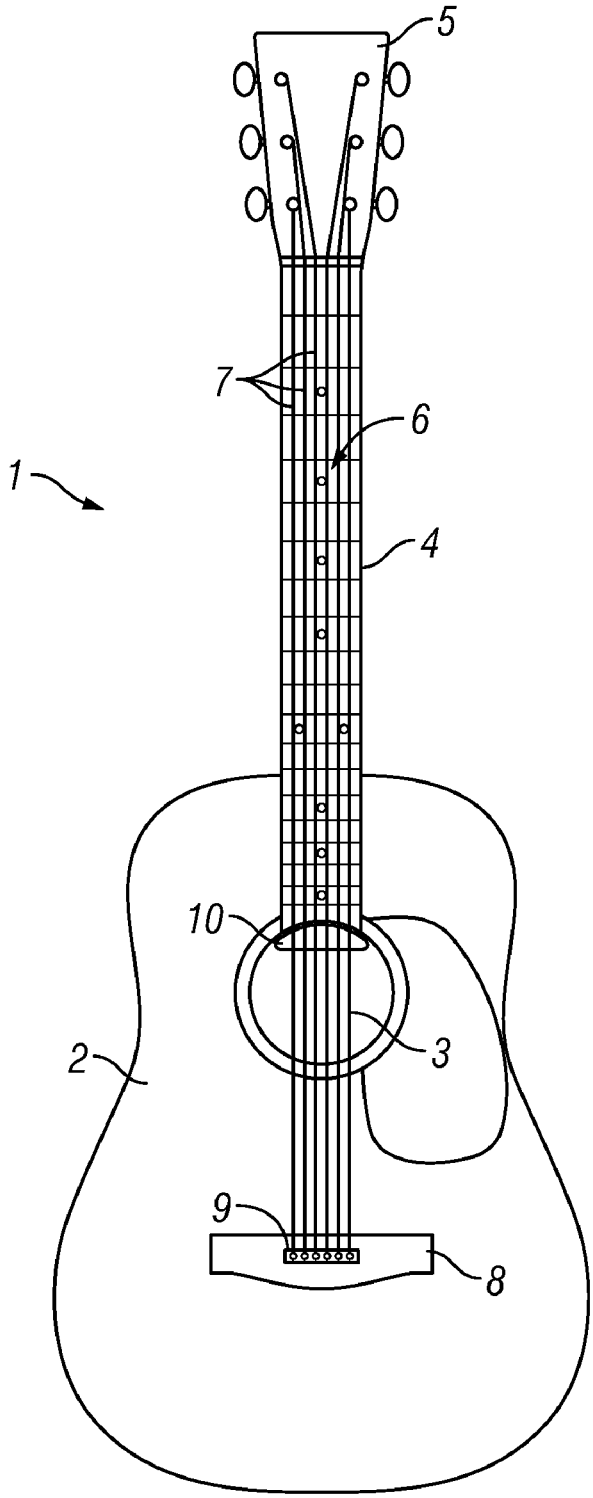
FIG. 1 is a top view of a guitar employing an embodiment of a detachable pickup assembly in accordance with the present disclosure.

FIGS. 1-4 illustrate an exemplary embodiment of a detachable pickup assembly 10. In FIG. 1, a guitar 1 employing the detachable pickup assembly 10 can be seen. Guitar 1 is an acoustic instrument having a hollow body 2, the top of which defines a substantially circular cutout 3. Neck 4 extends from cutout 3 to machine head 5 and includes fretboard 6. A plurality of strings 7 extends from anchorage 8 over bridge 9, cutout 3 and fretboard 6 to machine head 5.

Detachable pickup assembly 10 comprises a mounting assembly 12 and a pickup 14 mounted to the mounting assembly. The pickup 14 may be any pickup suitable for use with a musical instrument having magnetizable strings. The mounting assembly 12 includes two inter-engageable components, first body, or detachable body 16 and second body 18. First body 16 has a pickup mounting portion 20 and a connection mechanism 22 for interfacing with the second body 18. The pickup mounting portion 20 may be integrally formed with connection mechanism 22 or can be a separate component fastened to the connection mechanism 22 to form the first body 16.

In exemplary embodiments, the pickup mounting portion 20 of first body 16 is an elongate ring that defines a space 24 of a size and shape suitable for a pickup 14 to fit securely therein. The space 24 is substantially ovular in shape in disclosed embodiments, but it should be understood that any shape may be used so long as it accommodates the pickup. An aperture 19 accommodates a screw 17 or other suitable fastener, which can be loosened so that the pickup mounting portion 20 is flexible to ease insertion of pickup 14 and then tightened to secure the pickup 14 within the ring. A pickup support platform 21 may accompany the pickup mounting portion 20, and the bottom of the pickup 14 may be secured to the support platform 21 by screws or other suitable fasteners. A jack 15 is operatively coupled to the pickup to enable connection of a cable for output to an amplifier.

Referring to FIGS. 5A-6B, the connection mechanism 22 of first body 16 and connection portion 28 of second body 18 will be described. The connection mechanism 22 of first body 16 comprises one or more clip members 26. In exemplary embodiments, connection mechanism 22 includes three clip members, two end clip members 26*a*, 26*b* and one middle clip member 26*c*. Second body 18 defines a connection portion 28 sized to receive clip members 26 of first body 16. In exemplary embodiments, the connection portion 28 of second body 18 is defined by upper cross member 30 and two lower cross members 32*a*, 32*b*. The cross members 30 and 32*a*, 32*b* extend laterally across connection portion 28 of second body 18 between sidewalls 34*a*, 34*b*.

Figure 5A:
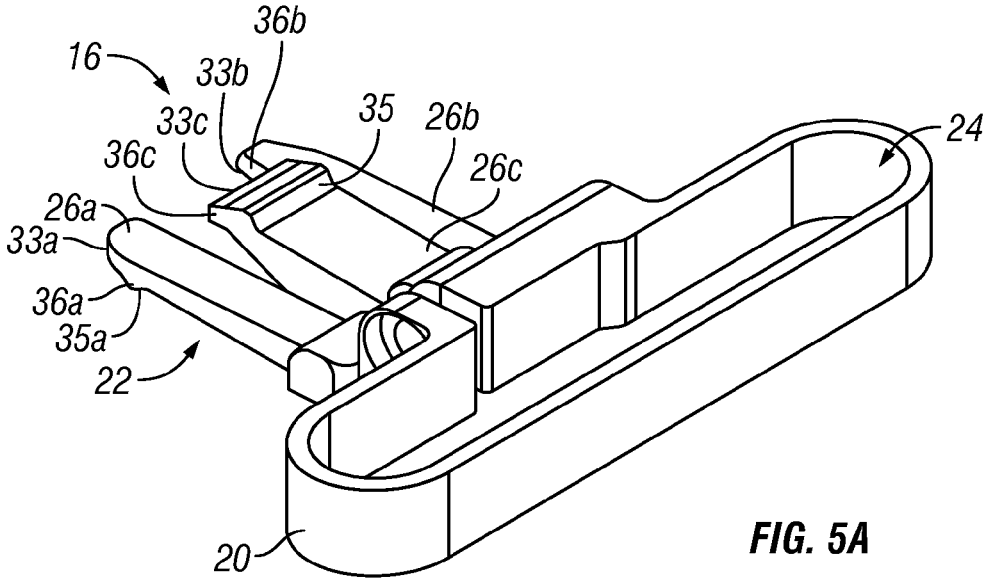
FIG. 5A is a perspective view of an embodiment of a detachable body portion of a detachable pickup assembly in accordance with the present disclosure.
Figure 5B:
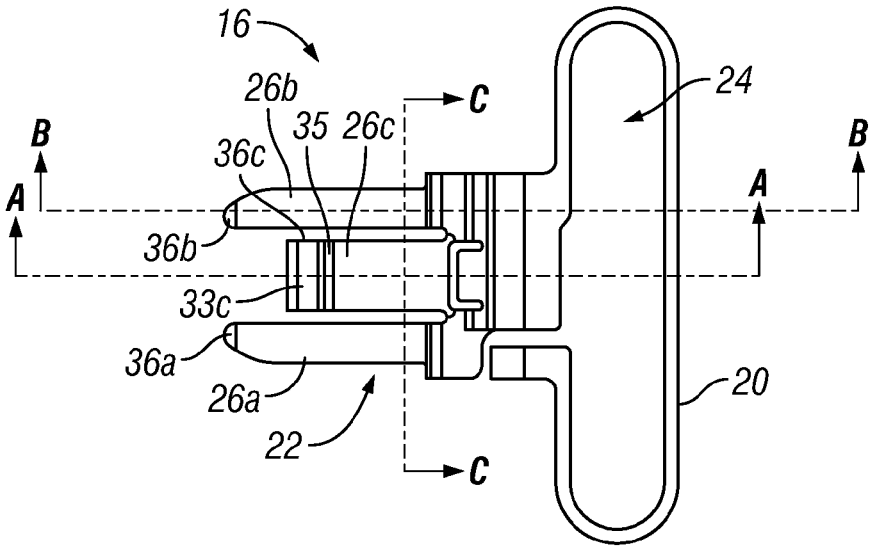
FIG. 5B is a top view of an embodiment of a detachable body portion of a detachable pickup assembly in accordance with the present disclosure.
Figure 6A:
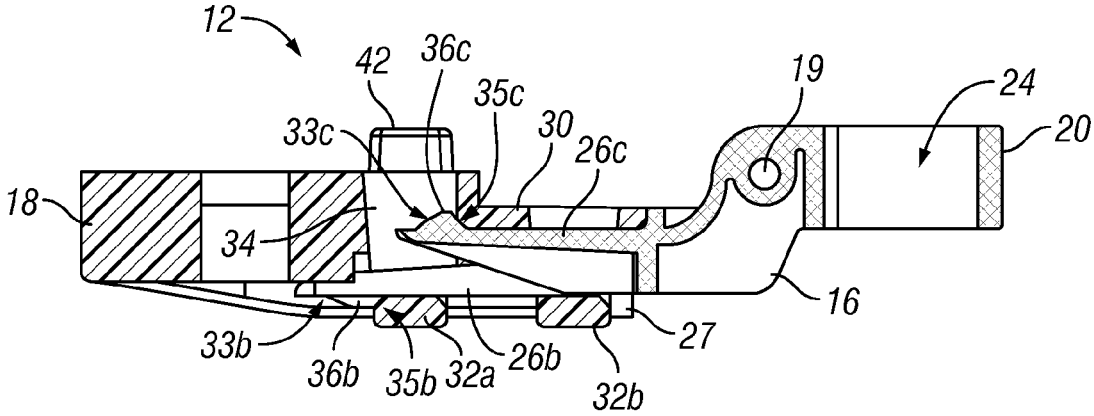
FIG. 6A is a side cross-sectional view taken along section A-A (FIG. 5B) of an embodiment of a mounting assembly of a detachable pickup assembly in accordance with the present disclosure.

Clip members 26 may include securing flanges 36 that engage cross members 30, 32*a* and 32*b* as described in more detail herein. More particularly, each end clip member 26*a*, 26*b* may have a respective securing flange 36*a*, 36*b*, and the middle clip member 26*c* may have a securing flange 36*c*. The securing flanges 36*a* and 36*b* may face in the opposite direction from that of securing flange 36*c*. For example, as best seen in FIGS. 5A and 6A securing flanges 36*a*, 36*b* of end clip members 26*a*, 26*b* may be downward facing and securing flange 36*c* of the middle clip member 26*c* may be upward facing.

Each securing flange 36*a*, 36*b*, 36*c* is tapered to form a front angled slope 33 and a rear angled slope 35. These slopes 33, 35 serve to facilitate removal of the connection mechanism 22, but also make the connection process easier. Middle clip member 26*c* may also have a slight upward slope relative to end clip members 26*a*, 26*b*. As discussed in more detail herein, this configuration facilitates more secure interconnection between the connection mechanism 22 of first body 16 and the connection portion 28 of second body 18. Clip members 26 may also comprise stops 27 to catch on cross member 32*b* and prevent connection mechanism 22 from penetrating too far into connection portion 28.

Figure 2:
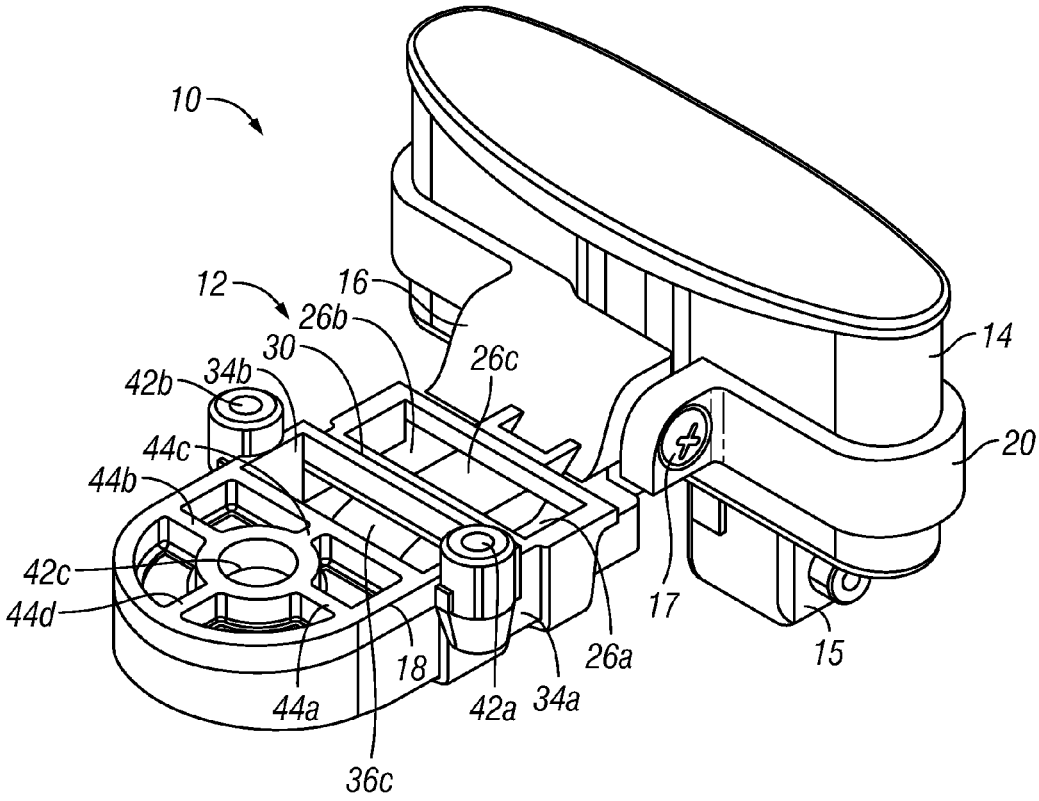
FIG. 2 is a perspective view of an embodiment of a detachable pickup assembly in accordance with the present disclosure.
Figure 3:
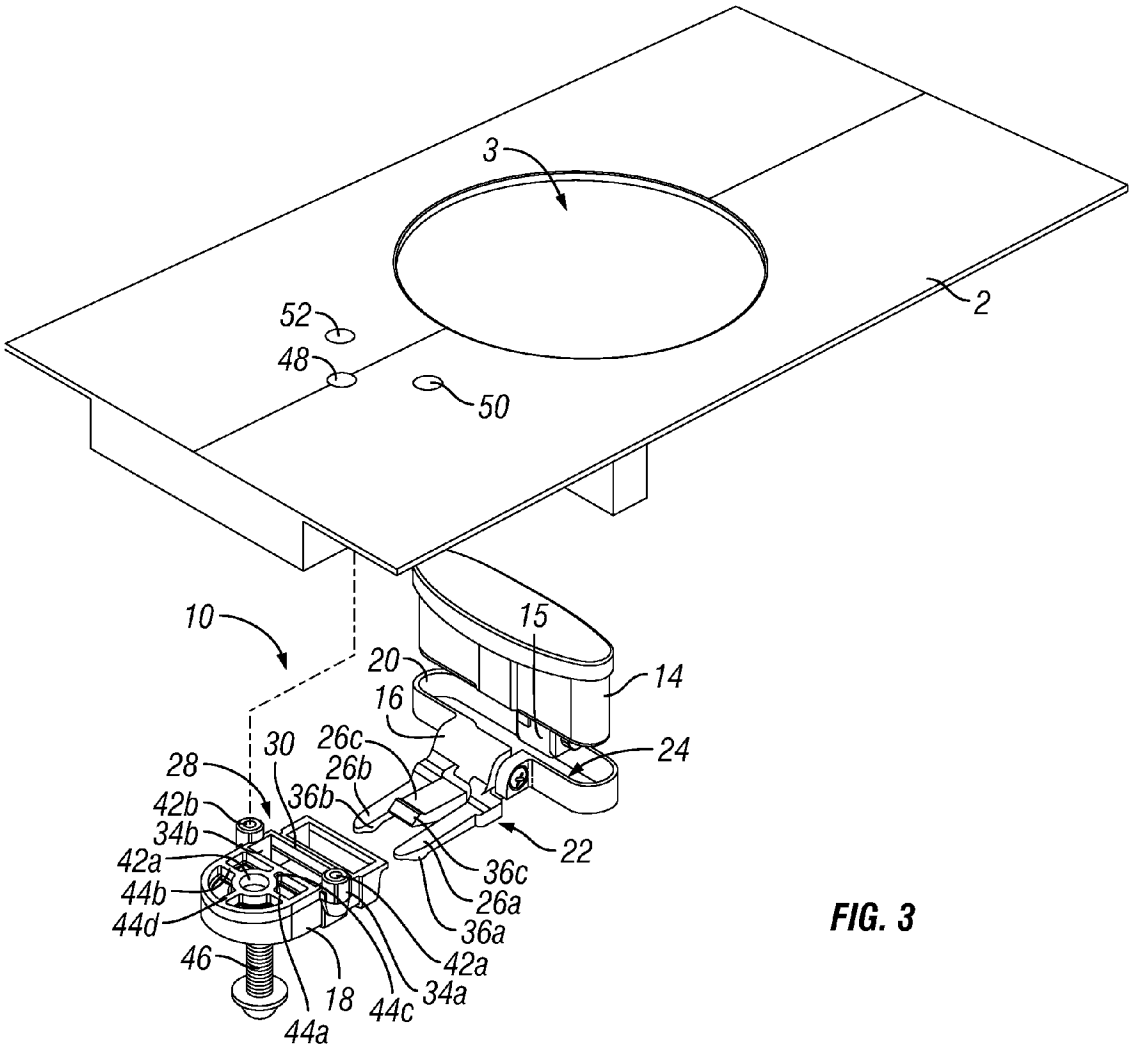
FIG. 3 is an exploded view of an embodiment of a detachable pickup assembly in accordance with the present disclosure.
Figure 4:
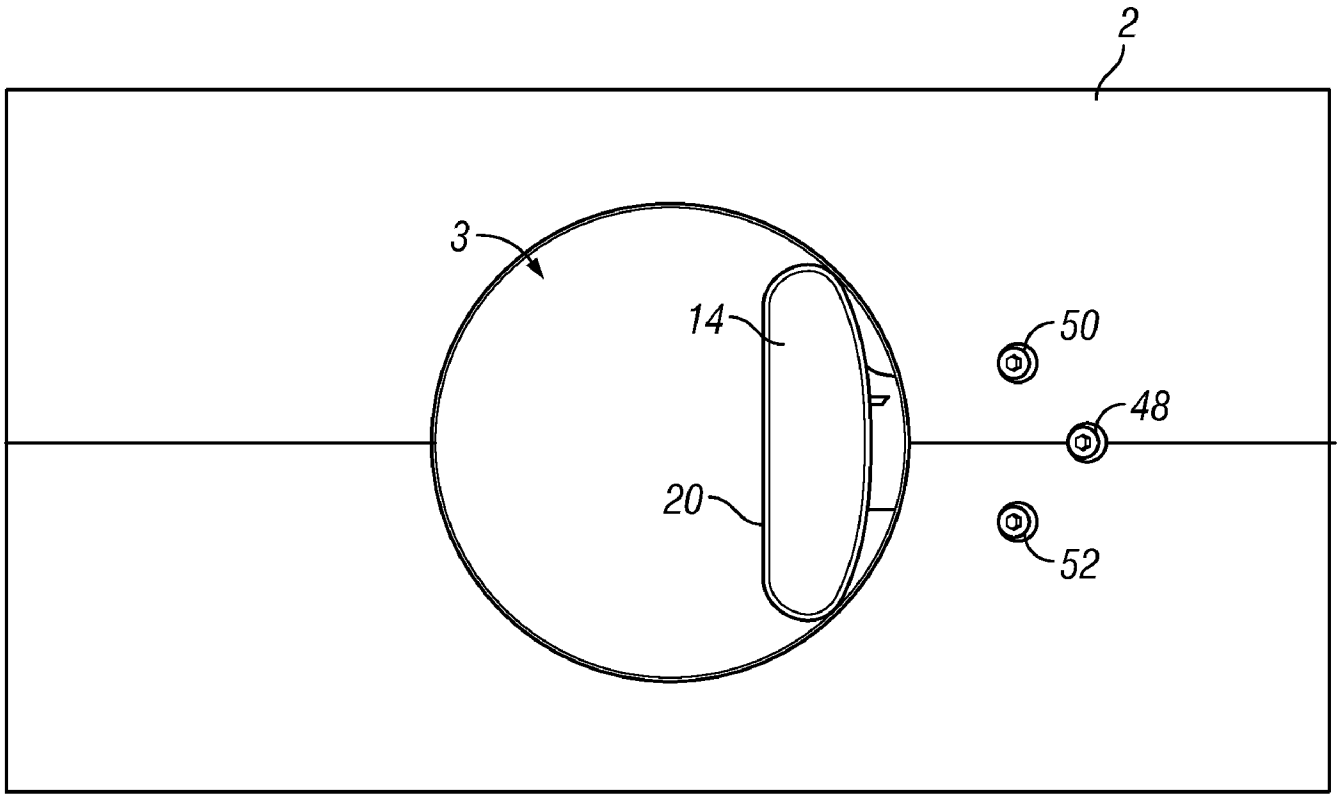
FIG. 4 is a top view of an embodiment of a detachable pickup assembly in accordance with the present disclosure shown attached to an instrument body.

The second body 18 further includes a top surface 38 that is engageable with the inside surface 40 of guitar body 2. Any type of fastening mechanism could be used to affix the second body 18 of mounting assembly 12 to the guitar body 2. Exemplary embodiments use screws or bolts, and the top surface 38 of the second body 18 may define one or more screw holes 42 through which such fasteners may be threaded. As best seen in FIG. 2, an embodiment of top surface 38 of the second body 18 defines three screw holes 42, two side screw holes 42*a*, 42*b* and a larger, center screw hole 42*c*. The top surface 38 may also include a network of support members 44*a*, 44*b*, 44*c*, 44*d* to provide strength and structural support to the mounting assembly 12.

Second body 18 is fixedly attached to the inside surface 40 of guitar body 2 by threading screw 46 from the top of the guitar body 2 through a first guitar screw hole 48*a* and then threading the screw 46 though a center screw hole 42*c* of the top surface 38. The guitar body 2 may define second and third guitar screw holes 50 and 52 that correspond to the two side screw holes 42*a*, 42*b* of the second body top surface 38. Additional screws may be threaded through the second and third guitar screw holes 50 and 52 and the two side screw holes 42*a*, 42*b* of the second body top surface 38 to more securely fasten the second body 18 of the mounting assembly 12 to the guitar body 2.

Figure 7:
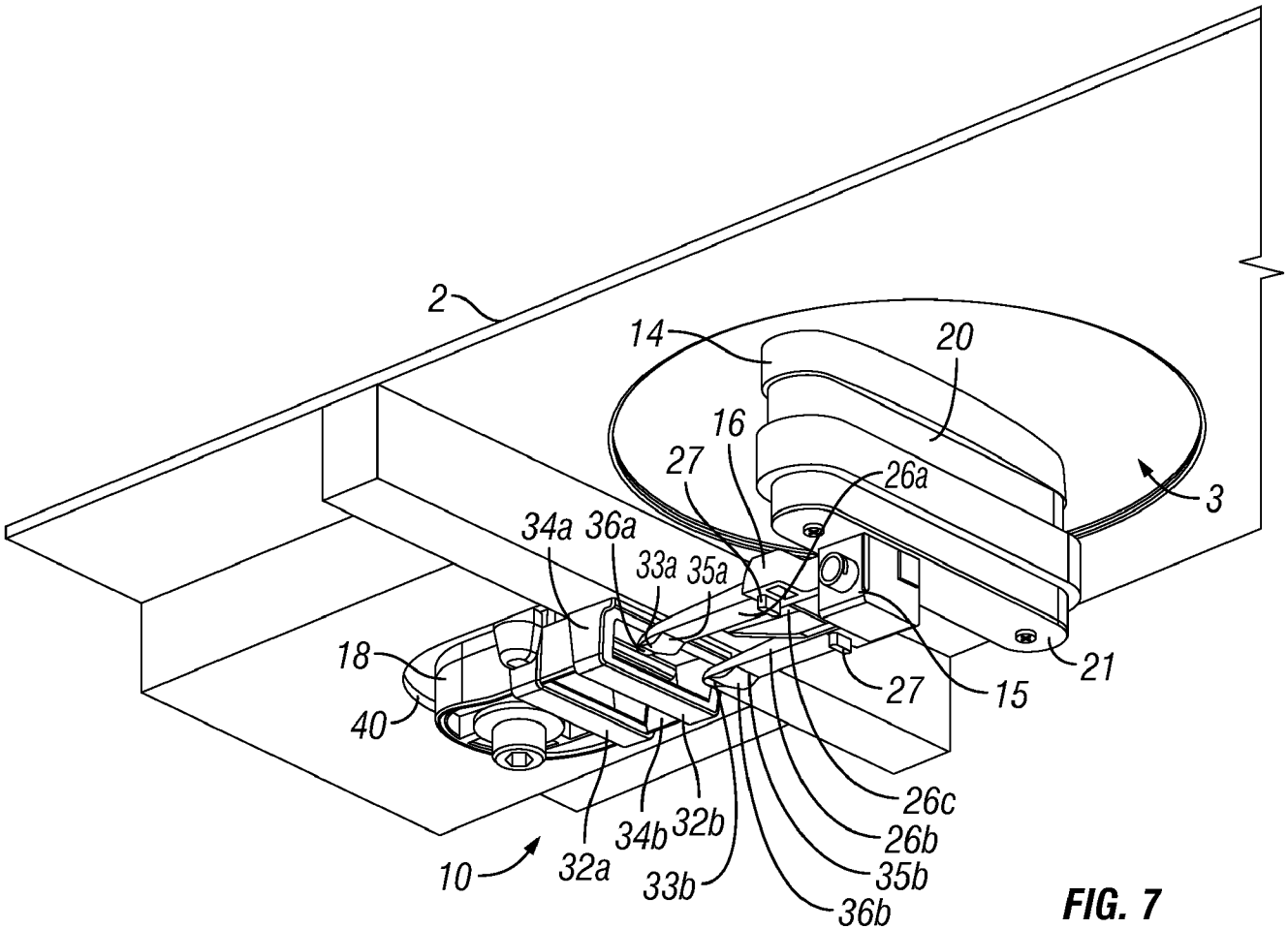
FIG. 7 is a perspective view of a detachable pickup assembly in accordance with the present disclosure shown in an unattached position.
Figure 8:
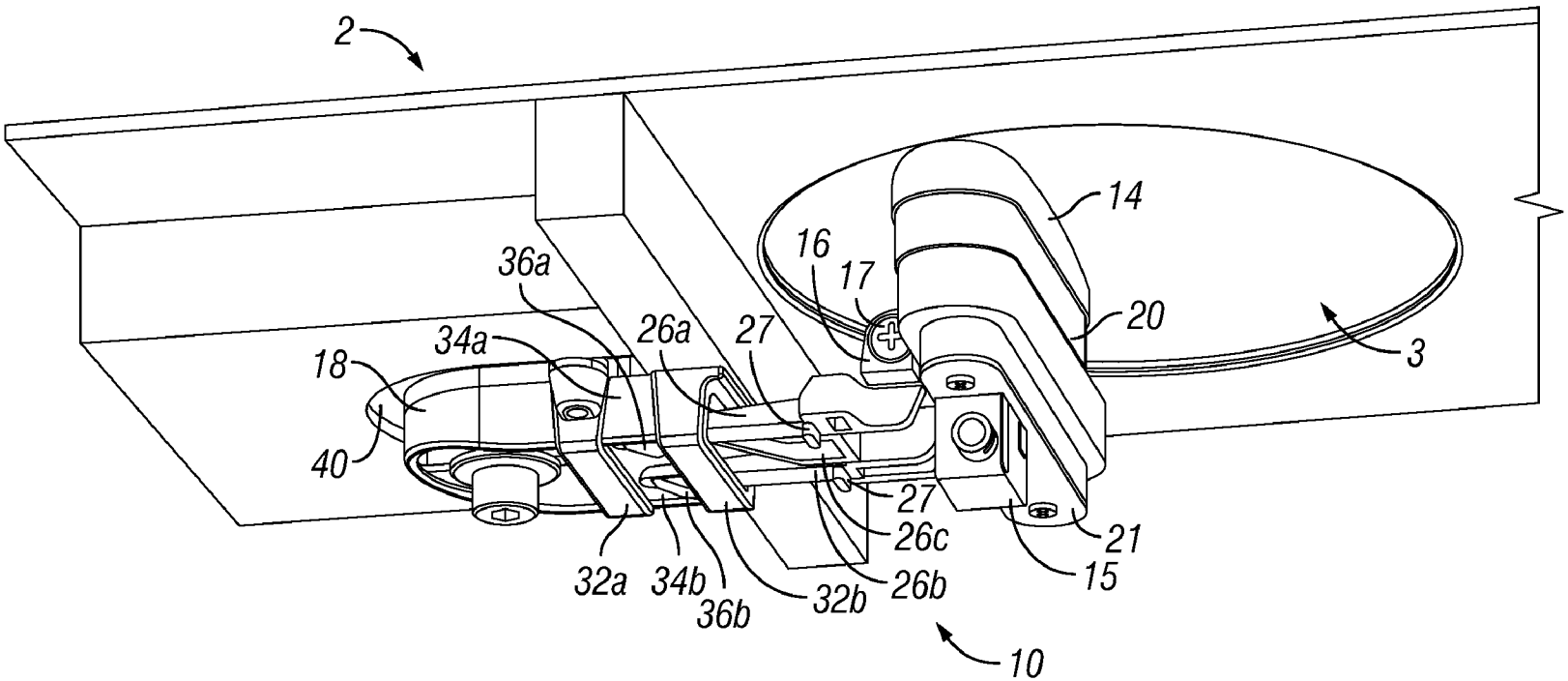
FIG. 8 is a perspective view of a detachable pickup assembly in accordance with the present disclosure shown in an intermediate position.
Figure 9:
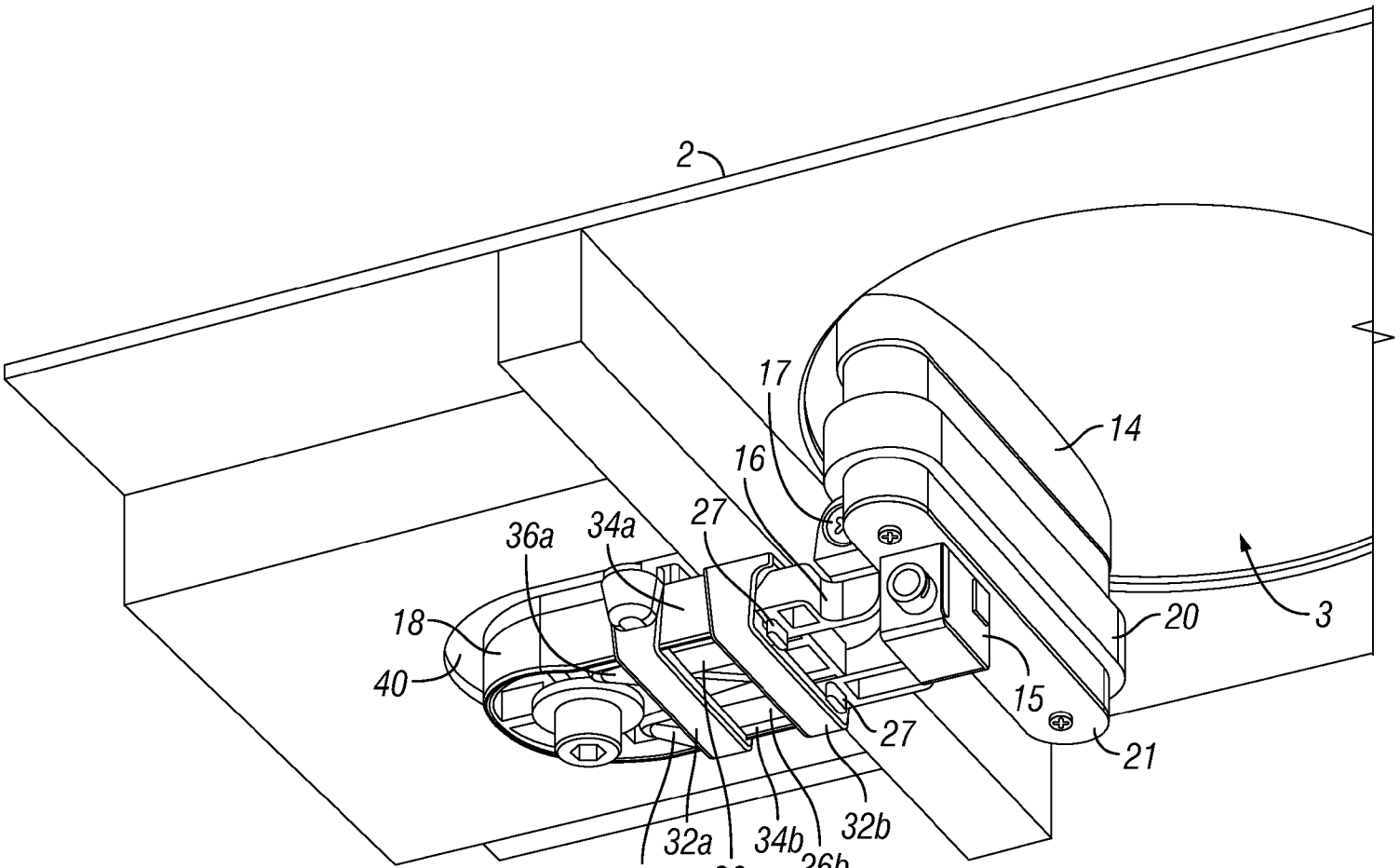
FIG. 9 is a perspective view of a detachable pickup assembly in accordance with the present disclosure shown in an attached position.

In operation, the strings 7 are either removed or sufficiently loosened so that the first body 16 of the mounting assembly 12 can be inserted through cutout 3 into the interior of guitar body 2. Referring to FIGS. 7-9, the first body 16 of the mounting assembly 12 is then connected to the second body 18 of the mounting assembly 12 by inserting the connection mechanism 22 of first body 16 into the connection portion 28 of second body 18. More particularly, the end clip members 26*a*, 26*b* and middle clip member 26*c* of first body connection mechanism 22 are inserted into the space defined by upper cross member 30 and lower cross members 32*a*, 32*b* of the second body connection portion 28. Front slopes 33*a*, 33*b* and 33*c* reduce the amount of pressure that needs to be exerted to push clip member 26*a*, 26*b*, 26 past the cross member 30, 32*a*, 32 and eases insertion for the user.

Figure 6B:
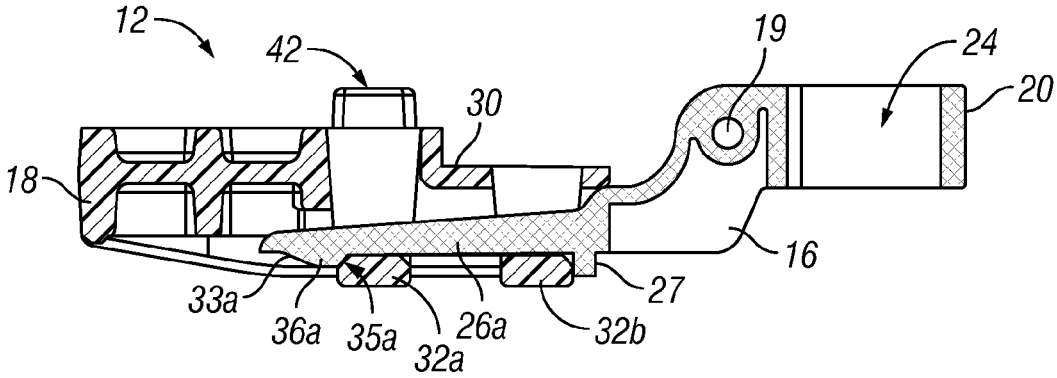
FIG. 6B is a side cross-sectional view taken along section B-B (FIG. 5B) of an embodiment of a mounting assembly of a detachable pickup assembly in accordance with the present disclosure.

As the clip members 26*a*, 26*b*, 26*c* are pushed into the connection portion 28, the securing flanges 36*a*, 36*b*, 36*c* form a snap fit with the cross members 20, 32*a*, 32*b*. Specifically, as best seen in FIGS. 6A, 6B and 9, securing flanges 36*a* and 36*b*, formed on the bottoms of the ends of end clip members 26*a* and 26*b*, respectively, form a secure fit with lower cross member 32*a*. Similarly, securing flange 36*c*, formed on the top of the end of middle clip member 26*c*, forms a secure fit with upper cross member 30. The upward slope of middle clip member 26*c* generates additional opposing forces between it and upper cross member 30 thereby creating a more secure fit between the connection mechanism 22 of first body 16 into the connection portion 28 of second body 18. Stops 27 catch on cross member 32*b* to provide a more secure engagement and prevent connection mechanism 22 from penetrating too far into connection portion 28.

To detach the detachable pickup assembly 10, the detachable body 16 is removed from its interconnection with second body 18. More particularly, connection mechanism 22 of detachable body 16 is pulled out of the connection portion 28 of the second body 18. Removal of the clip members 26*a*, 26*b*, 26*c* from their interlocked engagement with cross members 30, 32*a*, 32*b* is facilitated by rear slopes 35*a*, 35*b*, 35*c*, which make it easy for the user to pull securing flanges 36*a*, 36*b*, 36*c* across the cross members 30, 32*a*, 32*b*. The user simply pulls the detachable body 16, and the rear slopes 35*a*, 35*b*, 35*c* of securing flanges 36*a*, 36*b*, 36*c* slide across cross members 30, 32*a*, 32*b* without any need for application of undue force or depression of the clip members 26*a*, 26*b*, 26*c* to dislodge them from the cross members 30, 32*a*, 32*b*.

Once the connection mechanism 22 is completely removed from the connection portion 28, the detachable body 16 with the pickup 14 can be removed from the interior of the guitar body 2. The strings 7 may be removed or loosened so that the detachable body 16 of the mounting assembly 12 can be removed through the cutout 3. As will be appreciated by those of skill in the art, embodiments of the detachable pickup assembly 10 described herein can be used with other stringed musical instruments, including, but not limited to, violins, cellos, basses, sitars, mandolins and violas, without departing from the scope of the present disclosure.

Thus, it is seen that detachable pickup assemblies are provided. It should be understood that any of the foregoing configurations and specialized components may be interchangeably used with any of the systems of the preceding embodiments. Although preferred illustrative embodiments of the present disclosure are described hereinabove, it will be evident to one skilled in the art that various changes and modifications may be made therein without departing from the disclosure. It is intended in the appended claims to cover all such changes and modifications that fall within the true spirit and scope of the disclosure.

The invention claimed is:

1. A detachable pickup assembly comprising:

a mounting assembly including:

a first body having a pickup mounting portion and a connection mechanism comprising one or more clip members; and a second body defining a connection portion sized to receive the one or more clip members and having a top surface engageable with an inside surface of an instrument body; and a pickup fixedly mounted to the pickup mounting portion of the first body.

2. The detachable pickup assembly of claim 1 wherein the one or more clip members comprise two end clip members and one middle clip member.

3. The detachable pickup assembly of claim 2 wherein each of the two end clip members comprises a downward facing securing flange and the middle clip member comprises an upward facing securing flange.

4. The detachable pickup assembly of claim 3 wherein the connection portion of the second body is defined by upper and lower cross members.

5. The detachable pickup assembly of claim 4 wherein the securing flanges and the cross members form a snap fit.

6. The detachable pickup assembly of claim 2 wherein the middle clip member is sloped upward.

7. The detachable pickup assembly of claim 1 wherein the pickup mounting portion defines a ring in which the pickup is mounted.

8. The detachable pickup assembly of claim 1 further comprising a jack operatively coupled to the pickup.

9. A pickup mounting assembly comprising:

a first body having a pickup mounting portion and a connection assembly, the connection assembly having one or more clip members; and a second body defining a connection portion sized to receive the connection assembly and having a top surface engageable with an inside surface of a guitar body.

10. The mounting assembly of claim 9 further comprising a pickup fixedly mounted to the pickup mounting portion of the first body.

11. The mounting assembly of claim 9 wherein the one or more clip members comprise two end clip members and one middle clip member.

12. The mounting assembly of claim 9 wherein one or more of the one or more clip members comprises a downward facing securing flange and one or more of the one or more clip members comprises an upward facing securing flange.

13. The mounting assembly of claim 9 wherein the connection assembly of the first body and the connection portion of the second body form a snap fit.

14. The mounting assembly of claim 9 wherein the pickup mounting portion defines a ring portion in which the pickup is mounted.

15. An acoustic guitar, comprising:

a hollow-body guitar;

a detachable pickup assembly including:

a mounting assembly having:

a first body comprising a pickup mounting portion and a connection mechanism, the connection mechanism comprising one or more clip members; and a second body defining a connection portion sized to receive the connection mechanism and having a top surface fixedly mounted to an inside surface of the hollow-body guitar;

a pickup mounted to the pickup mounting portion of the first body;

a jack operatively coupled to the pickup.

16. The guitar of claim 15 wherein the one or more clip members comprise two end clip members and one middle clip member, each of the two end clip members comprising a downward facing securing flange and the middle clip member comprising an upward facing securing flange.

17. The guitar of claim 16 wherein the securing flanges form a snap fit with the connection portion.

18. The guitar of claim 15 wherein the pickup mounting portion defines a ring portion in which the pickup is mounted.

19. A pickup assembly configured for installation in an acoustic guitar, the pickup assembly comprising:

a connection mechanism configured for connection with a connection portion carried by a body installed on an interior surface of an acoustic guitar;

a pickup; and a jack operatively coupled to the pickup, the jack being separate from the connection mechanism.

20. The pickup assembly of claim 19, wherein the connection mechanism comprises one or more clip members.

21. The pickup assembly of claim 19, wherein the one or more clip members comprise two end clip members and one middle clip member, each of the two end clip members comprising a downward facing securing flange and the middle clip member comprising an upward facing securing flange.

* * * * *